US010941775B2

(12) United States Patent
Borkowski et al.

(10) Patent No.: US 10,941,775 B2
(45) Date of Patent: Mar. 9, 2021

(54) COMPRESSOR STOP VALVE AND ASSOCIATED SYSTEM

(71) Applicant: INGERSOLL-RAND INDUSTRIAL U.S., INC., Davidson, NC (US)

(72) Inventors: Michael Borkowski, Concord, NC (US); Christopher Taylor, Mooresville, NC (US); Eric M. Kaszuba, Statesville, NC (US)

(73) Assignee: INGERSOLL-RAND INDUSTRIAL U.S., INC., Davidson, NC (US)

( * ) Notice: Subject to any disclaimer, the term of this patent is extended or adjusted under 35 U.S.C. 154(b) by 350 days.

(21) Appl. No.: 15/856,966

(22) Filed: Dec. 28, 2017

(65) Prior Publication Data

US 2019/0203716 A1 Jul. 4, 2019

(51) Int. Cl.
*F04C 29/00* (2006.01)
*F04C 29/02* (2006.01)
(Continued)

(52) U.S. Cl.
CPC ..... *F04C 29/0014* (2013.01); *F04C 18/107* (2013.01); *F04C 18/16* (2013.01); *F04C 28/06* (2013.01); *F04C 28/125* (2013.01); *F04C 28/24* (2013.01); *F04C 29/02* (2013.01); *F04C 29/021* (2013.01); *F04C 29/026* (2013.01); *F25B 1/047* (2013.01); *F25B 31/002* (2013.01); *F25B 31/004* (2013.01); *F25B 49/022* (2013.01); *F04C 2210/14* (2013.01);
(Continued)

(58) Field of Classification Search
CPC ..... F04C 18/16; F04C 29/026; F04C 28/06; F04C 29/021; F04C 28/125; F04C 28/24; F04C 29/0014; F04C 2240/81; F04C 2270/19; F04C 2270/21; F04C 29/02; F04C 2210/14; F25B 1/047; F25B 49/022; F25B 31/002; F25B 31/004
See application file for complete search history.

(56) References Cited

U.S. PATENT DOCUMENTS 3,599,439 A 8/1971 Lewis et al.
3,795,117 A * 3/1974 Moody, Jr. ..... F25B 1/047 62/197
(Continued)

FOREIGN PATENT DOCUMENTS

GB 649960 2/1951

*Primary Examiner* — Peter J Bertheaud
(74) *Attorney, Agent, or Firm* — Kevin E. West; Advent, LLP

(57) ABSTRACT

A compressor system is provided that includes a contact cooled compressor and a coolant separator. The coolant separator is used to remove coolant fluid from a compressed flow stream produced by the contact cooled compressor during its operation. The coolant separator routes the removed coolant fluid back to the contact cooled compressor for further use. In some forms the coolant fluid is cooled prior to delivery back to the compressor. A stop valve can be provided in the coolant fluid return line to halt the flow of the fluid. A pressure sensitive member can be disposed to sense pressure of the coolant fluid that has been routed past the stop valve. Operation of the compressor can be changed as a result of the sensed pressure from the pressure sensitive member. Information from a temperature sensitive member can also be used to change operation of the compressor.

12 Claims, 1 Drawing Sheet

(51) Int. Cl.

| | |
|---|---|
| ***F04C 18/107*** | (2006.01) |
| ***F04C 18/16*** | (2006.01) |
| ***F04C 28/06*** | (2006.01) |
| ***F04C 28/12*** | (2006.01) |
| ***F04C 28/24*** | (2006.01) |
| ***F25B 49/02*** | (2006.01) |
| ***F25B 31/00*** | (2006.01) |
| ***F25B 1/047*** | (2006.01) |

(52) U.S. Cl.
CPC ..... *F04C 2240/81* (2013.01); *F04C 2270/19* (2013.01); *F04C 2270/21* (2013.01)

(56) References Cited

U.S. PATENT DOCUMENTS

| | | | | | |
|---|---|---|---|---|---|
| 4,081,636 | A | | 3/1978 | Rice | |
| 4,180,986 | A | * | 1/1980 | Shaw | F04C 28/06 418/84 |
| 4,200,080 | A | | 4/1980 | Cook et al. | |
| 5,318,151 | A | * | 6/1994 | Hood | F04C 29/021 184/6.1 |
| 5,626,470 | A | * | 5/1997 | Gerhardt | F04C 29/0021 184/6 |
| 5,697,763 | A | * | 12/1997 | Kitchener | F04C 28/06 417/28 |
| 7,547,203 | B2 | * | 6/2009 | Dieterich | F04C 28/16 418/2 |
| 8,006,514 | B2 | * | 8/2011 | Tsuboi | F25B 31/004 62/468 |
| 9,169,840 | B2 | * | 10/2015 | Yonemoto | F04C 18/16 |

* cited by examiner

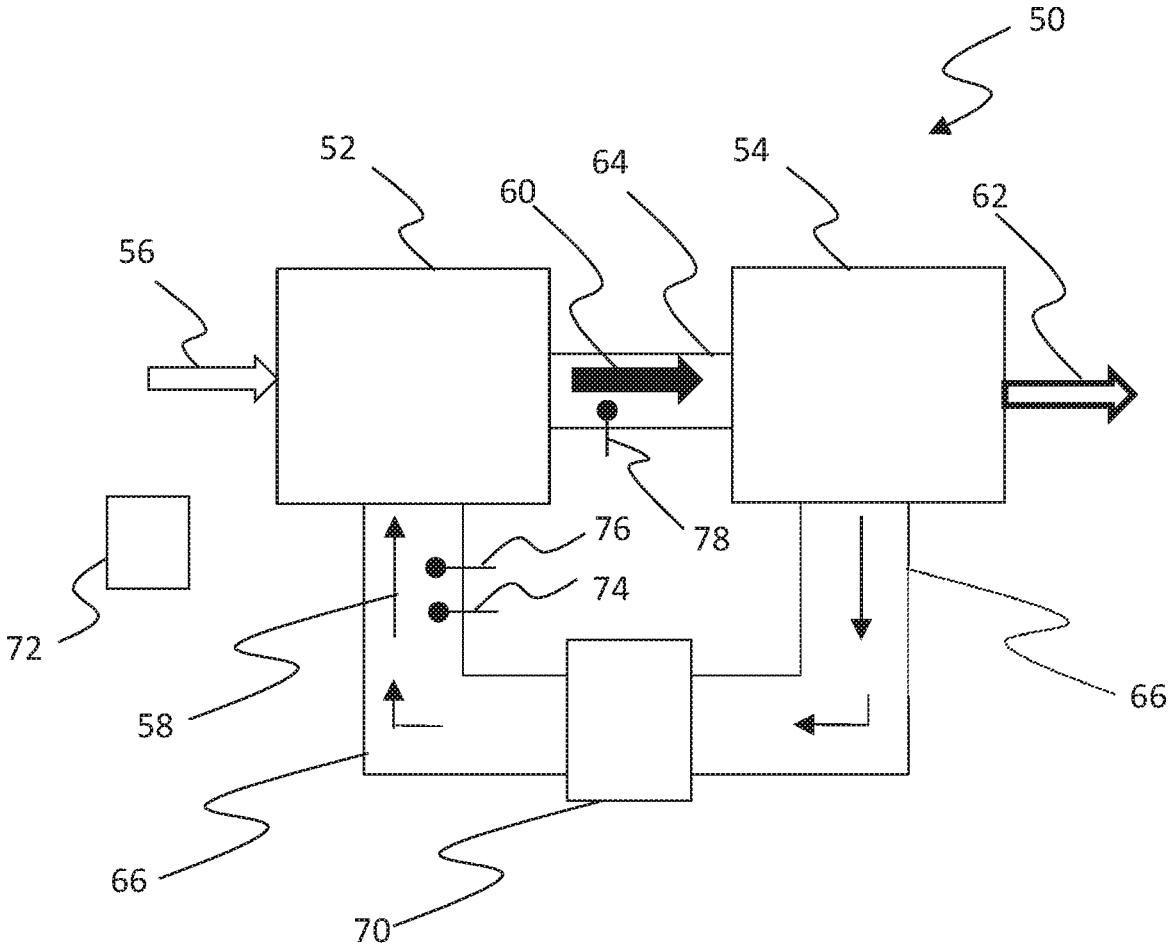
50
52
54
56
60
62
64
72
74
76
78
58
66
66
70

COMPRESSOR STOP VALVE AND ASSOCIATED SYSTEM

TECHNICAL FIELD

The present invention generally relates to operation of compressors having stop valves used to halt return of lubricant coolant to the compressor, and more particularly, but not exclusively, to oil filled compressors using coolant return stop valves.

BACKGROUND

Providing compressors that incorporate stop valves for return of lubricant coolant remains an area of interest. Some existing systems have various shortcomings relative to certain applications. Accordingly, there remains a need for further contributions in this area of technology.

SUMMARY

One embodiment of the present invention is a unique compressor and stop valve arrangement. Other embodiments include apparatuses, systems, devices, hardware, methods, and combinations for assessing performance of stop valves used on lubricant coolant return for compressors. Further embodiments, forms, features, aspects, benefits, and advantages of the present application shall become apparent from the description and figures provided herewith.

BRIEF DESCRIPTION OF THE FIGURES

The FIGURE illustrates an embodiment of a compressor having a stop valve.

DETAILED DESCRIPTION OF THE ILLUSTRATIVE EMBODIMENTS

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

With reference to the FIGURE, a compressor system 50 is illustrated which includes a compressor 52 and separator 54. An incoming flow of compressible gas 56, such as air, is received by the compressor 52 prior to being compressed. The compressor 52 can be any type of compressor which uses a moveable pressure changing member to raise pressure of the compressible gas in conjunction with a liquid 58 that is injected which aids in the compression process. The liquid 58 which is paired with the pressure changing member can take the form of oil, but other suitable liquids are also contemplated herein. Such liquid 58 can be used to lubricate, cool, and/or aid in sealing the compressor 52 during operation. Reference may be made below to a "cooling fluid," but it will be appreciated that no limitation is intended that such fluid must only perform a cooling function. Furthermore, reference may be made to "oil" in lieu of reference to "cooling fluid" as a matter of descriptive convenience, but no limitation is hereby intended unless stated or understood to the contrary that other cooling fluids would not also be useful.

As will be appreciated, examples of compressors 52 that use a cooling liquid 58 can include contact cooled or oil filled compressors. A moveable pressure changing member suitable for use in the compressor 52 can take many forms. For example, the moveable pressure changing member can be any type usable in a rotary compressor such as, but not limited to, a rotary screw compressor. In such instances the rotary compressor can include a pair of compression elements such as male and female helical shaped rotors structured to cooperate with one another and raise a pressure of the compressible gas as will be appreciated by those in the art.

The compressor system 50 is illustrated as also including the separator 54 which receives a mixed flow 60 of compressed gas and cooling liquid produced by the compressor, where the separator 54 is used for separating compressed air from the cooling liquid. The separator 54 is thus capable of producing a flow of compressed gas 62 and the flow of cooling liquid 58. The separator 54 can operate on a variety of principles, and thus can take a variety of forms. Some examples of separators include those that employ a media filter, those that operate on the basis of centrifugal separation, and/or those that rely upon impingement action such as those that employ separator tanks having one or more baffles disposed therein. In some embodiments more than one type of separator can be used with any given compressor. For example, in one embodiment the compressor can operate in conjunction with a centrifugal separator paired with a separator having a media filter. Thus, although the illustrated schematic depicts a single block designated as 54, no limitation is hereby intended regarding the type or numbers of separators that can be used with the compressor 52.

It will be appreciated that the entrained mixture 60 of air and cooling fluid is processed through the separator 54 by action of the pressure imparted by operation of the compressor 52. The separator 54 receives the mixed flow through a conduit/passageway 64, and passes separated cooling fluid to conduit/passageway 66. The conduits/passageways 64 and 66, along with any other conduits/passageways useful with the systems described herein can take any shape and form, and be made from a variety of materials. No limitation is intended regarding such conduits/passageways unless otherwise stated or understood to the contrary. To set forth just one nonlimiting example, conduit/passageway 66 can be made of two separate ducts that are joined. The separator 54 may retain a portion of pressure even after operation of the compressor 52 has ceased. Pressure developed as a result of operation of the compressor may furthermore be used to urge the cooling fluid through conduit/passageway 66 before being reintroduced to the compressor 52. Thus, the power delivered to provide a pressurized flow 60 and 62 is also sufficient to provide energy to drive and deliver a flow of liquid 58 to the compressor 52.

In the event that the compressor 52 is shut down, a residual amount of pressure may remain, at least for a period of time, in various components subject to the nature of the components and any associated valving. Such residual pressure may persist until such time as it is relieved, either through active pressure relief mechanisms or through passive bleed off of air as would naturally occur given the mechanical set up of the compression system. In one form the separator 54 can retain a head of pressurized air internal therein to drive the liquid to the compressor 52, at least for a period of time, until it is relieved.

Valve 70 can be used to restrict flow of the cooling fluid 58 to the compressor 52 from the separator 54, one nonlimiting example of which is configured as a stop valve. The valve 70 can take on a variety of forms and can be activated passively or through use of a controller. In some forms the valve 70 can be mechanical, electrical, or electromechanical, and can have at least two operating states, open and closed. The valve 70 can be activated using any variety of approaches to change its operating state. To set forth just a few nonlimiting nonlimiting examples, the valve 70 can be activated by a controller upon a startup of the compressor system 50 to an open condition to permit flow of cooling fluid. In another nonlimiting example, the valve 70 can be activated by a pressure switch that samples pressure exiting from the compressor 52. If the pressure switch detects insufficient pressure produced from the compressor 52 (such as would occur as a result of a shutdown condition) then a signal can be sent to the valve 70 to be placed in the closed operating state. Such a closed state is useful to stop the flow of cooling fluid 58. In other forms the valve 70 can be activated to either a closed or open state based upon receipt of a signal from a controller, such as but not limited to controller 72. In short, the valve 70 can be activated using any variety of approaches based upon any variety of conditions.

The controller 72 is provided to monitor and control compressor operations. The controller 72 can be comprised of digital circuitry, analog circuitry, or a hybrid combination of both of these types. Also, the controller 72 can be programmable, an integrated state machine, or a hybrid combination thereof. The controller 72 can include one or more Arithmetic Logic Units (ALUs), Central Processing Units (CPUs), memories, limiters, conditioners, filters, format converters, or the like which are not shown to preserve clarity. In one form, the controller 72 is of a programmable variety that executes algorithms and processes data in accordance with operating logic that is defined by programming instructions (such as software or firmware). Alternatively or additionally, operating logic for the controller 72 can be at least partially defined by hardwired logic or other hardware. It should be appreciated that controller 72 can be exclusively dedicated to monitoring and/or acting on information that permits regulation of the valve 70, but other uses are also envisioned, such as those described further below.

The compressor system 50 can further include any number of pressure and temperature sensitive members useful to sense an operating characteristic of one or more portions of the compressor system 50. For example, pressures and/or temperatures can be sensed of the fluid coolant 58, of the compressed gas 62, of the mixed flow 60, etc. The locations of each of these pressures can also vary in some form. For example, a pressure can alternatively be sensed of the compressed gas 62 in lieu of or in addition to the mixed flow 60. In the illustrated embodiment, the compressor system 50 includes a pressure sensitive member 74 to sense pressure of the fluid coolant 58, a temperature sensitive member 76 to sense a temperature of the fluid coolant 58, and a temperature sensitive member 78 to sense a temperature of a flow produced by the compressor 60. The pressure and/or temperature sensitive members can take any variety of forms. For example, the pressure sensitive member can take the form of a pressure switch or a pressure transducer, but other suitable devices are also contemplated. An example of a temperature sensitive member is a thermocouple, but other suitable devices are also contemplated.

Sensed temperature and/or sensed pressure provided by any of the members 74, 76, and 78 can be expressed in any number of different forms. To set forth just a few nonlimiting examples, a sensed temperature can take the form of a signal voltage used as input to an electronic controller. Another example includes a sensed temperature that is in the form of a binary numerical expression. Yet another example is a sensed pressure that is in the form of a mechanical reactive device (see further below). In short, sensed temperatures and pressures as used herein are not intended to be strictly limited to a single type of expression but can take on many different forms suitable for any particular implementation of the structures and techniques described herein.

As used herein, the term "sensed pressure" or similar phrase can represent either physical sensing of pressure which is translated to a mechanical movement of some type of actuation device, or it can represent a conversion of some type of physical sensing into an electrical signal, the information of which can useful with other electronic devices such as the controller 72. For example, a physical sensing of pressure can take the form of a suitable device such as a capsule, bellows, diaphragm, piston element, etc which causes actuation via sympathetic movement of a lever, contact, etc which reacts to changes from the suitable device as it experiences a change in pressure. One example of a device capable of physically sensing pressure is a pressure switch. One nonlimiting example of a device capable of electronically sensing pressure is a pressure transducer. Other examples of devices that can sense pressure, whether of the mechanical, electrical, or electro-mechanical variety are also contemplated herein. Thus, no limitation is intended regarding the form of a device capable of sensing pressure, whether of the examples provided herein or otherwise.

The compressor system 50 can be configured to use one or more of the members 74, 76, and 78, and in some embodiments also the controller 72, to regulate one or more operations of the system 50. In one form, pressure member 74 is used to determine whether cooling fluid 58 is pressurized to a sufficient degree to be fed to the compressor 52. The pressure member 74 can be used in some forms to infer whether the stop valve 70 has opened to permit flow of cooling fluid 58 to be fed to the compressor 52, but other types of issues such as a faulty conduit/passageway, etc, are also capable envisioned as being mitigated by the techniques described herein.

In such a situation in which the stop valve 70 has not opened or has only partially opened (or other issues that manifest in low pressure), the pressure sensitive member 74 may detect insufficient pressure to properly operate the compressor 52 without unwanted wear and/or damage. Such insufficient pressure can be manifested as either a pressure that is below a threshold, or pressure that fails to rise above a threshold. In such a situation of insufficient pressure the pressure member 74 can operate as a pressure switch connected to the operation of the compressor 52. For example, the pressure switch can generate a signal (electrical or mechanical) that interrupts a power supply to the compressor 52, or interrupts a power train of the compressor 52, etc to halt operation. Such a switch can be configured to halt operation when the compressor 52 is first started up, it can be enabled a set time after a startup signal to halt operation, and/or it can be enabled as an interlock to prevent full startup of the compressor, among potential other configurations. In short, the pressure sensitive member 74 can be used in a variety of manners to stop, prevent, and/or shut down the compressor 52 if insufficient oil is present at some point in time in the conduit 66 in the event of a full or partial failure of the stop valve 70. The pressure member 74 could alternatively be configured as a transducer to generate a sensed pressure which can be conveyed to the controller 72. Similar to the implementation of the pressure switch above, the controller 72 can be used to interrupt a power supply to the compressor 52, or interrupt a power train of the compressor 52, etc upon receipt of a sensed pressure from the member 74 that insufficient pressure is present in the conduit/passageway 66 downstream of the stop valve 70. The function of power interruption of the compressor 52 can likewise occur when the compressor is started up, after a set time following a startup signal, and/or function as an interlock to prevent full startup of the compressor 52, among potential others.

The compressor system 50 can alternatively and/or additionally be configured to use the temperature member 76 (in conjunction with the controller 72 in some embodiments) to further regulate operation of the system 50. The controller 72 can be configured to utilize sensed temperature from the temperature member 76 and infer an undesired temperature elsewhere in the system 50. The controller 72 can utilize a relationship between a sensed temperature of the coolant fluid 58 provided by member 76 and a temperature elsewhere in the system 50, and use that relationship in the controller to infer performance or operation of the system 50. For example, temperatures sensed by the member 76 of the coolant fluid 58 will generally rise by an additional amount upon use within the heat producing compressor 52, and thus temperatures sensed by member 78 will typically vary by an additional amount from temperatures sensed by member 76. Such additional amounts can be quantified and/or estimated based upon empirical data or technical principles. Whichever method by which the additional amounts are derived, those additional amounts can be used in a scheme to infer acceptable temperatures at the temperature member 78 by first using sensed temperature from temperature member 76, biasing or adjusting the temperature sensed at 76 using the aforementioned additional amount, and evaluating the biased/adjusted amount by a criteria.

One use of a calculation/adjustment from temperature member 76 to temperature member 78 permits use of temperature member 76 in instances in which temperature member 78 is imperfect, faulty, or otherwise unsuitable. For example, in some applications temperature member 78 can be used to monitor system health, but the temperature member 78 may nevertheless include an inherent time lag which may cause a delay in controller action. A lag time may be avoided if sensed temperature were to be utilized from member 76 and then offset to represent the biased/adjusted additional amount determined above. Such an approach could take the following form: if temperature sensed by member 76 is high enough, such temperature can indicate insufficient temperature to properly lubricate and cool the compressor and corrective action can be taken by the controller which is in contrast to the delayed controller action based upon the lagged temperature member 78. This approach could be in addition, or alternative to, a primary approach that relies upon sensed temperature from member 78.

When the temperature sensed by member 76 satisfies a sufficient level to intercede in the operation of the compressor 52, the controller 72 can take corrective action, such as but not limited to shutting down the compressor 52. A sufficient level sensed by the member 76 can be manifested as either a temperature that is above a threshold, or a temperature that is at or above the threshold. The temperature used in the determination of whether the threshold condition is satisfied can either be the sensed temperature from member 76, or a sensed temperature from 76 that is biased/adjusted using the additional amount (an example of which was discussed above). For example, assuming that the offset between temperature sensed at 76 and temperature sensed at 78 is in some cases as low as 10 degrees and in some cases as high as 50 degrees, the controller 72 can take action when temperature at 76 is somewhere between 10 and 50 degrees less than an unacceptable temperature that can be inferred to exist at member 78. Such a range in differences in the operating temperatures can be the result of equipment or installation differences, ambient environment changes, and whether a cooling system includes extra capacity in any given environment.

In some cases, it may be desirable to account for worst case scenario and plan to take early action using an offset taken from the higher end of the typical range (in this nonlimiting example that would be using the 50 degree upper limit). For the further sake of providing an example, assuming that temperature shutdown occurs when member 78 senses 228 degrees Fahrenheit (F). The controller 72 in the instant application can be configured to shut down the compressor 52 when the temperature at member 76 reaches anywhere between 178 degrees F. (228 degrees-50 degree offset) and 218 degrees F. (228 degrees-10 degree offset). In the worst case scenario, the conditional can be configured to provide shutoff either at or above the 178 degree sensed temperature at member 76. In other embodiments, in lieu of shutdown at the worst case scenario (i.e. 50 degree offset to result in 178 degrees sensed temperature at 74 in this example), warnings can be provided at some point between the high end and the low end of the range (e.g. at 180 degrees Fahrenheit in the example above). Shutdown could therefore occur at a temperature higher than the 50 degree offset but lower than the 10 degree offset. In those embodiments employing a warning somewhere between the high and low offset, the shutdown could occur at a higher level than the warning (e.g. at 190 degree F. to continue the example from above). Other schemes are also contemplated herein.

The incorporation of the members 74, 76, and/or 78, along with the controller 70, can be realized either through concurrent integration with other aspects of the compressor system 50 such as the separator 52 and passages 64, 66, etc, or can be retrofit on existing systems.

One or more features of the systems and approaches described herein can be incorporated into and transmit information over a network. For example, information from any of the members 74, 76, and 78 can be transmitted to a central portal/database/server/etc and used to provide historical archiving of data, trend analysis, troubleshooting, etc. Such abilities as are sometimes referred to as the internet-of-things are also contemplated herein.

One aspect of the present application provides an apparatus comprising an oil filled compressor structured to raise a pressure of a compressible fluid, wherein oil within the oil filled compressor is used to lubricate and cool a pair of compressor elements, an oil reservoir coupled with a conduit for the provision of oil to the oil filled compressor, the conduit structured to convey oil under pressure to the oil filled compressor from the oil reservoir, oil stop valve disposed within the conduit intermediate the oil reservoir and the oil filled compressor, the oil stop valve configured to selectively stop the flow of oil from the oil reservoir to the oil filled compressor, and a pressure sensitive member structured to sense a fluid pressure in the conduit downstream of the oil stop valve and wherein an operating state of the oil filled compressor is dependent upon the sensed fluid pressure.

A feature of the present application further includes an oil separator structured to receive a mixed flow of oil and compressed fluid from the oil filled compressor, the conduit structured to receive oil that has been separated by action of the oil separator, wherein the oil separator remains pressurized for a period following cessation of operation of the oil filled compressor, and wherein the operating state of the oil filled compressor is a state in which the oil filled compressor is placed to mitigate damage if the sensed fluid pressure is below a threshold.

Another feature of the present application includes wherein the oil stop valve is structured to selectively stop the flow of oil when the compressor is not operating and selectively permit the flow of oil to the oil filled compressor when the oil filled compressor is operating.

Yet another feature of the present application includes wherein the pressure sensitive member can be a pressure switch or a pressure transducer.

Still another feature of the present application further includes a controller structured to halt operation of the oil filled compressor.

Yet still another feature of the present application includes wherein the controller is structured to halt operation of the oil filled compressor when a sensed pressure fails to achieve a threshold pressure.

Still yet another feature of the present application further includes a temperature sensitive member in thermal communication with oil flowing through the conduit, the controller structured to halt operation of the oil filled compressor when a sensed temperature from the temperature sensitive member which is biased to form an estimated temperature exceeds an operational threshold.

A yet further feature of the present application includes wherein the pressure sensitive member is a pressure switch.

Another aspect of the present application provides an apparatus comprising a fluid compression system having a contact cooled compressor structured to receive a compressible fluid for compression and receive a cooling liquid used for lubrication via a cooling fluid passage, the fluid compression system also including a cooling fluid stop valve structured to halt flow of the cooling liquid in the cooling fluid passage prior to introduction into the contact cooled compressor and a pressure member structured to react to a pressure within the cooling fluid passage downstream from the cooling fluid stop valve, the contact cooled compressor driven by a shaft and operative to change a torque condition of the shaft based upon a reaction of the pressure member to the pressure within the cooling fluid passage intermediate the contact cooled compressor and the cooling fluid stop valve.

A feature of the present application includes wherein the pressure member is one of a pressure switch and a pressure transducer, and which further includes an air-oil separation device structured to receive an outlet flow of compressed compressible fluid and cooling liquid from the contact cooled compressor.

Another feature of the present application further includes a controller structured to receive a signal from a pressure transducer and command a change in torque.

Still another feature of the present application includes wherein pressure developed from operation of the contact cooled compressor aids the flow of cooling liquid through the cooling fluid passage.

Yet another feature of the present application includes wherein residual pressure developed from operation of the contact cooled compressor urges cooling liquid to flow in the cooling fluid passage after operation of the contact cooled compressor has ceased.

Still yet another feature of the present application further includes a temperature sensitive member structured to sense the temperature of the cooling liquid prior to introduction into the contact cooled compressor.

Yet still another feature of the present application further includes a controller for evaluating whether the sensed temperature of the cooling liquid exceeds an estimated threshold.

A yet further feature of the present application includes wherein the pressure member is a pressure switch.

Still another aspect of the present application provides a method comprising powering a contact cooled compressor structured to receive a flow of gas via a gas inlet and a flow of contact coolant via a contact coolant inlet, producing a flow of compressed gas as a result of the operating, sensing a pressure in a contact coolant passage downstream of a coolant stop valve and upstream of the contact coolant inlet, operating a stop valve to halt the flow of contact coolant during a first phase of operation of the contact cooled compressor, and during a second phase of operation, triggering a shut down of the contact cooled compressor when a sensed pressure downstream of the coolant stop valve fails to satisfy an inequality condition.

A feature of the present application includes wherein the inequality condition can be less than or less than/equal to a predetermined pressure.

Another feature of the present application further includes routing compressed air through an oil separator to provide back pressure driven flow through the contact coolant passage, and wherein a pressure switch is configured to perform the sensing a pressure.

Still another feature of the present application further includes operating a controller to regulate operational state of the contact cooled compressor.

Yet another feature of the present application further includes a temperature sensor configured to sense a temperature of the contact coolant, the controller further structured to regulate operational state of the contact cooled compressor as a function of the sensed temperature of the contact coolant.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. An apparatus comprising:

an oil filled compressor structured to raise a pressure of a compressible fluid, wherein oil within the oil filled compressor is used to lubricate and cool a pair of compressor elements;

an oil reservoir coupled with a conduit for the provision of oil to the oil filled compressor, the conduit structured to convey oil under pressure to the oil filled compressor from the oil reservoir;

oil stop valve disposed within the conduit intermediate the oil reservoir and the oil filled compressor, the oil stop valve configured to selectively stop the flow of oil from the oil reservoir to the oil filled compressor;

a controller structured to halt operation of the oil filled compressor;

a pressure sensitive member structured to sense a fluid pressure in the conduit downstream of the oil stop valve and wherein an operating state of the oil filled compressor is dependent upon the sensed fluid pressure;

a temperature sensitive member in thermal communication with oil flowing through the conduit, wherein a temperature determined by the temperature sensitive member is biased to form an estimated temperature, and wherein the controller is structured to halt operation of the oil filled compressor when the estimated temperature exceeds an operational threshold.

2. The apparatus of claim 1, which further includes an oil separator structured to receive a mixed flow of oil and compressed fluid from the oil filled compressor, the conduit structured to receive oil that has been separated by action of the oil separator, wherein the oil separator remains pressurized for a period following cessation of operation of the oil filled compressor, and wherein the operating state of the oil filled compressor is a state in which the oil filled compressor is placed to mitigate damage if the sensed fluid pressure is below a threshold.

3. The apparatus of claim 2, wherein the oil stop valve is structured to selectively stop the flow of oil when the compressor is not operating and selectively permit the flow of oil to the oil filled compressor when the oil filled compressor is operating.

4. The apparatus of claim 3, wherein the pressure sensitive member can be a pressure switch or a pressure transducer.

5. The apparatus of claim 4, wherein the controller is structured to halt operation of the oil filled compressor when a sensed pressure fails to achieve a threshold pressure.

6. The apparatus of claim 1, wherein the pressure sensitive member is a pressure switch.

7. An apparatus comprising:

a fluid compression system having a contact cooled compressor structured to receive a compressible fluid for compression and receive a cooling liquid used for lubrication via a cooling fluid passage, the fluid compression system also including a cooling fluid stop valve structured to halt flow of the cooling liquid in the cooling fluid passage prior to introduction into the contact cooled compressor and a pressure member structured to react to a pressure within the cooling fluid passage downstream from the cooling fluid stop valve, the contact cooled compressor driven by a shaft and operative to change a torque condition of the shaft based upon a reaction of the pressure member to the pressure within the cooling fluid passage intermediate the contact cooled compressor and the cooling fluid stop valve;

a temperature sensitive member structured to sense the temperature of the cooling liquid prior to introduction into the contact cooled compressor; and a controller for evaluating whether a biased temperature of the sensed temperature of the cooling liquid exceeds an estimated threshold.

8. The apparatus of claim 7, wherein the pressure member is one of a pressure switch and a pressure transducer, and which further includes an air-oil separation device structured to receive an outlet flow of compressed compressible fluid and cooling liquid from the contact cooled compressor.

9. The apparatus of claim 8, wherein the pressure member is a pressure transducer, and which further includes a controller structured to receive a signal from the pressure transducer and command a change in torque.

10. The apparatus of claim 8, wherein pressure developed from operation of the contact cooled compressor aids the flow of cooling liquid through the cooling fluid passage.

11. The apparatus of claim 10, wherein residual pressure developed from operation of the contact cooled compressor urges cooling liquid to flow in the cooling fluid passage after operation of the contact cooled compressor has ceased.

12. The apparatus of claim 10, wherein the pressure member is a pressure switch.

* * * * *